United States Patent [19]

Meeker

[11] 4,419,837

[45] Dec. 13, 1983

[54] APPARATUS FOR DISPLAYING ADVERTISING MATERIAL

[75] Inventor: David M. Meeker, Saratoga, Calif.

[73] Assignee: Champion International Corporation, Stamford, Conn.

[21] Appl. No.: 276,877

[22] Filed: Jun. 24, 1981

Related U.S. Application Data

[63] Continuation of Ser. No. 808,603, Jun. 21, 1977, abandoned.

[51] Int. Cl.[3] ..... B65D 27/08

[52] U.S. Cl. ..... 40/359; 40/124.2; 40/124.4; 40/405; 229/72; 229/1.5 R

[58] Field of Search ..... 40/124.4, 405, 359, 40/400, 124.2; 229/72, 1.5 R

[56] References Cited

U.S. PATENT DOCUMENTS

| | | | |
|---|---|---|---|
| 1,408,531 | 3/1922 | Potter | 40/359 |
| 1,464,378 | 8/1923 | Wilburger | 229/72 |
| 1,730,644 | 10/1929 | Clark | 40/359 |
| 2,226,976 | 12/1940 | Leaming | 40/405 |
| 2,421,503 | 6/1947 | Hermon | 40/405 |
| 2,775,050 | 12/1956 | Ellsworth | 40/124.2 |
| 3,292,632 | 12/1966 | Hopen | 40/405 |
| 3,870,223 | 3/1975 | Wyant | 229/72 |
| 3,979,051 | 9/1976 | Close | 229/72 |
| 4,043,063 | 8/1977 | Ambasz | 40/405 |
| 4,173,837 | 11/1979 | Kiejzik | 229/72 |

*Primary Examiner*—Robert P. Swiatek
*Assistant Examiner*—David I. Tarnoff
*Attorney, Agent, or Firm*—Evelyn M. Sommer; John H. Mulholland; William W. Jones

[57] ABSTRACT

A carrier for displaying a plurality of envelopes may be mounted in a conventional loose-leaf binder, and is generally rectangular in configuration. The carrier is formed by folding a sheet about a medial line to form front and back panels, with the front panel including flap portions that are folded over and bonded to the back panel. Elongated slots are provided in the front and back panels, generally parallel to the folded edge of the carrier, and display envelopes may be partially inserted through each said slot, and carried by the carrier for display purposes. In the method for displaying envelopes, a loose-leaf binder and a plurality of such carriers are provided, and each display envelope is partially inserted into selected slots of the carrier whereby at least a portion of each envelope is visible for display purposes, and with each envelope being releasably disposed in the carrier.

1 Claim, 3 Drawing Figures

APPARATUS FOR DISPLAYING ADVERTISING MATERIAL

This is a continuation of application Ser. No. 808,603, filed June 21, 1977, now abandoned.

The present invention relates to a new and improved display carrier for advertising materials, such as sample envelopes. More particularly, the subject invention is directed to a display carrier which is adapted to be releasably connected to a conventional loose-leaf binder, and which includes out of alignment structural means for releasably carrying a plurality of sample envelopes in such a manner that at least a part of the envelope is visible to the customer when the sample envelope is fully accommodated in the carrier, and yet the envelope may be readily removed from the carrier for further inspection by the customer. In addition, the subject invention provides a new and improved method for displaying advertising materials, such as sample envelopes.

Heretofore, conventional means for displaying sample envelopes usually have taken the form of a loose-leaf binder including a plurality of sheets that are coated, at least in part, by a latex adhesive material so that the sample envelope may be releasably connected to the opposed facing surfaces of the sheets of the ring binder. With continued use of the sample binder, the releasable bond between the envelope and the display sheet usually weakens, such that after a period of time, the sample envelopes become disengaged from the sheets, whereby the effectiveness of the display binder is greatly comprised.

In order to overcome the shortcomings of the prior art display devices for displaying advertising materials, such as sample envelopes, the present invention provides a new and improved display carrier, as well as a new and improved method for displaying advertising materials. The subject display carrier is generally rectangular in plan form, and includes apertures for releasable engagement with the rings of the conventional looseleaf binder. The carrier is formed of a single sheet that is folded along a first edge, usually the bottom edge of the sheet, so as to form front and back panels that are contiguous. One panel is of greater area than the other panel, so as to include flaps which are then folded along the associated edges and bonded to the other panel, thereby providing a complete enclosure carrier. Elongated slots are preferably provided in both the front panel and the back panel of the carrier, and are disposed generally parallel to the bottom edge, and are located at convenient positions whereby a sample envelope may be readily inserted into an elongated slot. As inserted, the sample envelope is maintained in position for display purposes, and at least a portion of the envelope is readily visible to the customer. The sample envelope is readily removed from the carrier for further inspection by the customer. In applicant's process, a conventional ring binder is provided with a plurality of display carriers as mentioned above, and the sample envelopes are partially inserted into selected slots of the carriers whereby at least a portion of each sample envelope is visible, with each sample envelope being releasably disposed in the carrier.

Further objects and advantages of the invention will become apparent from a reading of the following detailed description, taken in conjunction with the drawings in which.

Figure 1:
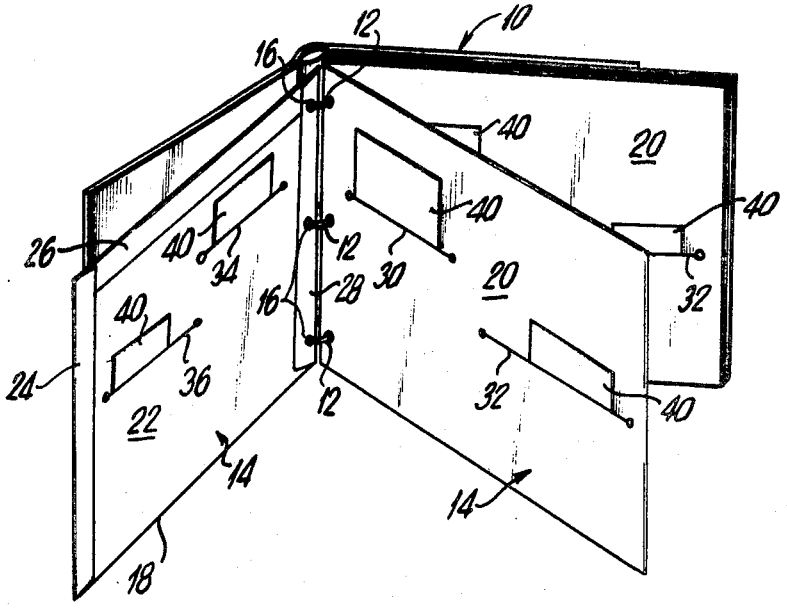
FIG. 1 is a perspective view of a conventional loose-leaf binder including a plurality of display carriers, according to the subject invention.
Figure 2:
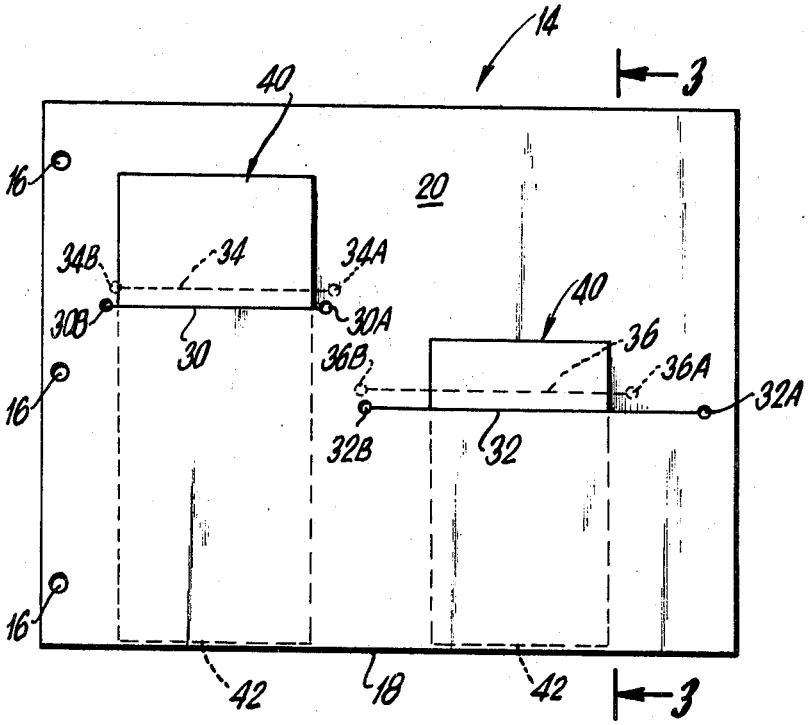
FIG. 2 is an elevational view of a display carrier according to the subject invention.
Figure 3:
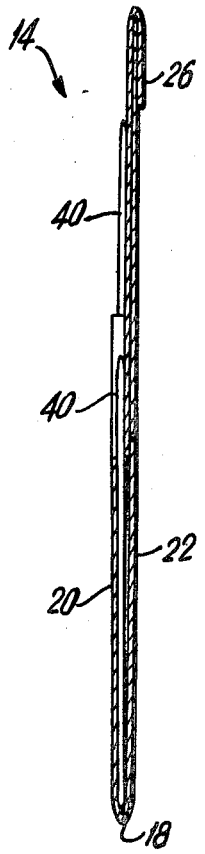
FIG. 3 is a sectional view taken along line 3—3 in FIG. 2.

Referring to FIG. 1, a conventional loose-leaf binder 10 including snap rings 12 is shown engaging a plurality of display carriers 14 according to the subject invention. Each display carrier 14 includes spaced apertures 16 that are engaged by the rings 12. As also shown in FIGS. 2 and 3, each display carrier 14 is formed of a single sheet of paper, preferably coated with a wax-like finish for enhancing the durability and for facilitating the insertion and removal of sample envelopes from the display carriers, as more fully mentioned hereinafter. The single sheet forming each display carrier is folded about a medial line to form the bottom edge 18, and a front panel 20, as well as a back panel 22. Preferably the area of the front panel is greater than the area of the back panel 22 thereby defining flaps 24, 26 and 28 which overlap and are bonded to the back panel 22. Accordingly, the resulting display carrier has a folded bottom edge 18, and is closed on the remaining three sides by flaps 24, 26 and 28.

As more particularly shown in FIG. 2, the front panel 20 includes slots 30 and 32 which extend generally parallel to the bottom edge 18, and which are preferably spaced at different distances from said bottom edge. Slot 32 preferably terminates in annular openings 30A and 30B. Similarly, slot 32 terminates in annular openings 32A and 32B. In order to accommodate additional sample envelopes, the back panel 22 may include similar slots 34 and 36, which also terminate in annular openings respectively designated 34A, 34B and 36A, 36B.

Sample envelopes to be displayed by the display carriers 14 are slidably inserted into the respective slots 30–36, and as shown in FIG. 2, the location of the slots is designed to insure that at least more than half of each sample envelope 42 is disposed within the display carrier 14. By this arrangement, each display envelope 40 is maintained firmly in place, yet it is only partially inserted into the display carrier 14, and with the bottom edge 42 of each envelope preferably engaging the inside portion of the bottom edge 18 of the display carrier. Each sample envelope is slidably received within the display carrier, whereby the customer may readily remove the sample envelope for further inspection. Preferably, as shown in FIG. 2, the locations of the slots 30–36 are varied to accommodate may different sizes and shapes of sample envelopes.

In applicant's process for displaying a plurality of sample envelopes, a loose-leaf binder including the subject display carriers is provided, and each sample envelope is partially inserted into a slot for display purposes. Each envelope may be readily removed from the carrier for further inspection, and subsequently reinserted into the carrier. The widths of the slots may be varied to accommodate different size envelopes.

Although the invention has been described and illustrated in a single embodiment, various modifications and alterations may be made without departing from the spirit and scope of the invention as defined by the claims.

What is claimed is:

1. A display carrier for display of a plurality of differently sized sample envelopes in a loose leaf binder, said display carrier being generally rectangular in configuration and consisting of a sheet folded along a medial line thereof to form an envelope engaging first edge and defining a front panel and a back panel, said front panel being of greater area than said back panel and including flaps extending along the three remaining free edges, each flap being folded along its associated edge and bonded to the back panel, said front panel and back panel each having a plurality of differently sized elongated slots formed therein, each said slot in the front panel and back panel being disposed parallel to said envelope engaging first edge of the display carrier, with each of the slots in the front panel and back panel being spaced at different lengths from said envelope engaging first edge, out of alignment with other slots in its respective panel and with the ends of each said differently sized slot terminating in annular openings whereby the differently sized envelopes to be displayed each may be inserted into one of said slots to engage said envelope engaging first edge and thereby be maintained in position for display purposes, the spacing of said slots from said envelope engaging first edge being such as to permit each slot to receive more than half of its respective sample envelope, said display carrier further including aligned, spaced apertures extending through the front panel, back panel, and a flap portion, along one edge disposed perpendicular to said envelope engaging first edge to enable said display carrier to be releasably retained in a loose-leaf binder.

* * * * *

UNITED STATES PATENT AND TRADEMARK OFFICE

CERTIFICATE OF CORRECTION

PATENT NO. : 4,419,837

DATED : December 13, 1983

INVENTOR(S) : DAVID M. MEEKER

It is certified that error appears in the above—identified patent and that said Letters Patent is hereby corrected as shown below:

Col. 2, line 28, after the word "includes" insert therefor -- out of alignment -- ;

Col. 2, line 31, delete "slot 32" and insert therefor -- slot 30 -- ;

Col. 2, line 51, delete the word "may" and insert therefor -- many -- .

Signed and Sealed this

*Fifth* Day of *November 1985*

[SEAL]

*Attest:*

*Attesting Officer*

DONALD J. QUIGG

*Commissioner of Patents and Trademarks*